US005401930A

United States Patent [19]

Eastlund

[11] Patent Number: 5,401,930

[45] Date of Patent: Mar. 28, 1995

[54] VEHICULAR POWER CUT OFF APPARATUS

[76] Inventor: Edgar H. Eastlund, R.R.#1, Box 73I, Magnolia, Del. 19962

[21] Appl. No.: 47,981

[22] Filed: Apr. 19, 1993

[51] Int. Cl.[6] ..... H01H 17/18

[52] U.S. Cl. ..... 200/543; 200/254; 200/313; 200/331

[58] Field of Search ..... 200/331, 330, 43.03, 200/48 RB, 254, 313, 314, 61.7, 61.85, 52 R, 538, 543; 307/9.1, 10.1, 10.2, 10.7; 74/501.6; 180/287

[56] References Cited

U.S. PATENT DOCUMENTS

| | | | |
|---|---|---|---|
| 1,553,621 | 9/1925 | Locklin | 74/501.6 X |
| 1,956,484 | 4/1934 | Bate | 180/287 X |
| 2,490,675 | 12/1949 | Clare | 200/543 |
| 2,611,061 | 9/1952 | Richardson et al. | 200/543 |
| 2,659,791 | 11/1953 | Dickinson | 200/331 X |
| 2,786,921 | 3/1957 | List | 200/543 |
| 3,623,569 | 11/1971 | Wilkins | 180/287 |
| 3,997,749 | 12/1976 | Hanagan . | |
| 4,092,506 | 5/1978 | Saulters | 307/10.2 X |
| 4,515,237 | 5/1985 | Gonzalez et al. | 307/10.2 X |
| 4,591,675 | 5/1986 | Sessum | 200/254 X |
| 5,270,505 | 12/1993 | Magiera | 200/331 |

*Primary Examiner*—Renee S. Luebke
*Attorney, Agent, or Firm*—E. Michael Combs

[57] ABSTRACT

A switch member mechanically operatively functional through a cable directed into the passenger compartment of the associated motor vehicle is arranged to effect discontinuance of grounding to the battery of the associated vehicle, wherein the switch member includes a pivotal blade mounted in selective electrical communication between first and second bifurcated contact posts. A mounting bracket within the passenger compartment directs illumination onto a pull handle that in turn is secured to the cable.

2 Claims, 4 Drawing Sheets

VEHICULAR POWER CUT OFF APPARATUS

BACKGROUND OF THE INVENTION

1. Field of the Invention

The field of invention relates to power cut off structure, and more particularly pertains to a new and improved vehicular power cut off apparatus wherein the same is arranged for remote operation within an associated vehicle.

2. Description of the Prior Art

A vehicular power disconnect switch is indicated in U.S. Pat. No. 3,997,749 to Hanagan wherein an actuator means is arranged for displacing the knife blade structure of the switch on a cable removing a detent relative to the knife blade structure.

The instant invention attempts to overcome deficiencies of the prior art by employing a vehicular power cut off knife blade switch organization, wherein the same is arranged to provide for ease of mounting, as well as ease of access, to the pull cable structure within an associated vehicle and in this respect, the present invention substantially fulfills this need.

SUMMARY OF THE INVENTION

In view of the foregoing disadvantages inherent in the known types of power cut off switch structure now present in the prior art, the present invention provides a vehicular power cut off apparatus wherein the same is directed to the power cut off of electrical energy within an associated vehicle upon operative employment of a pull cable structure.

To attain this, the present invention provides a switch member mechanically operatively functional through a cable directed into the passenger compartment of the associated motor vehicle arranged to effect discontinuance of grounding to the battery of the associated vehicle, wherein the switch member includes a pivotal blade mounted in selective electrical communication between first and second bifurcated contact posts.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular power cut off apparatus which has all the advantages of the prior art power cut off switch structure and none of the disadvantages.

It is another object of the present invention to provide a new and improved vehicular power cut off apparatus which may be easily and efficiently manufactured and marketed.

It is a further object of the present invention to provide a new and improved vehicular power cut off apparatus which is of a durable and reliable construction.

An even further object of the present invention is to provide a new and improved vehicular power cut off apparatus which is susceptible of a low cost of manufacture with regard to both materials and labor, and which accordingly is then susceptible of low prices of sale to the consuming public, thereby making such vehicular power cut off apparatus economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
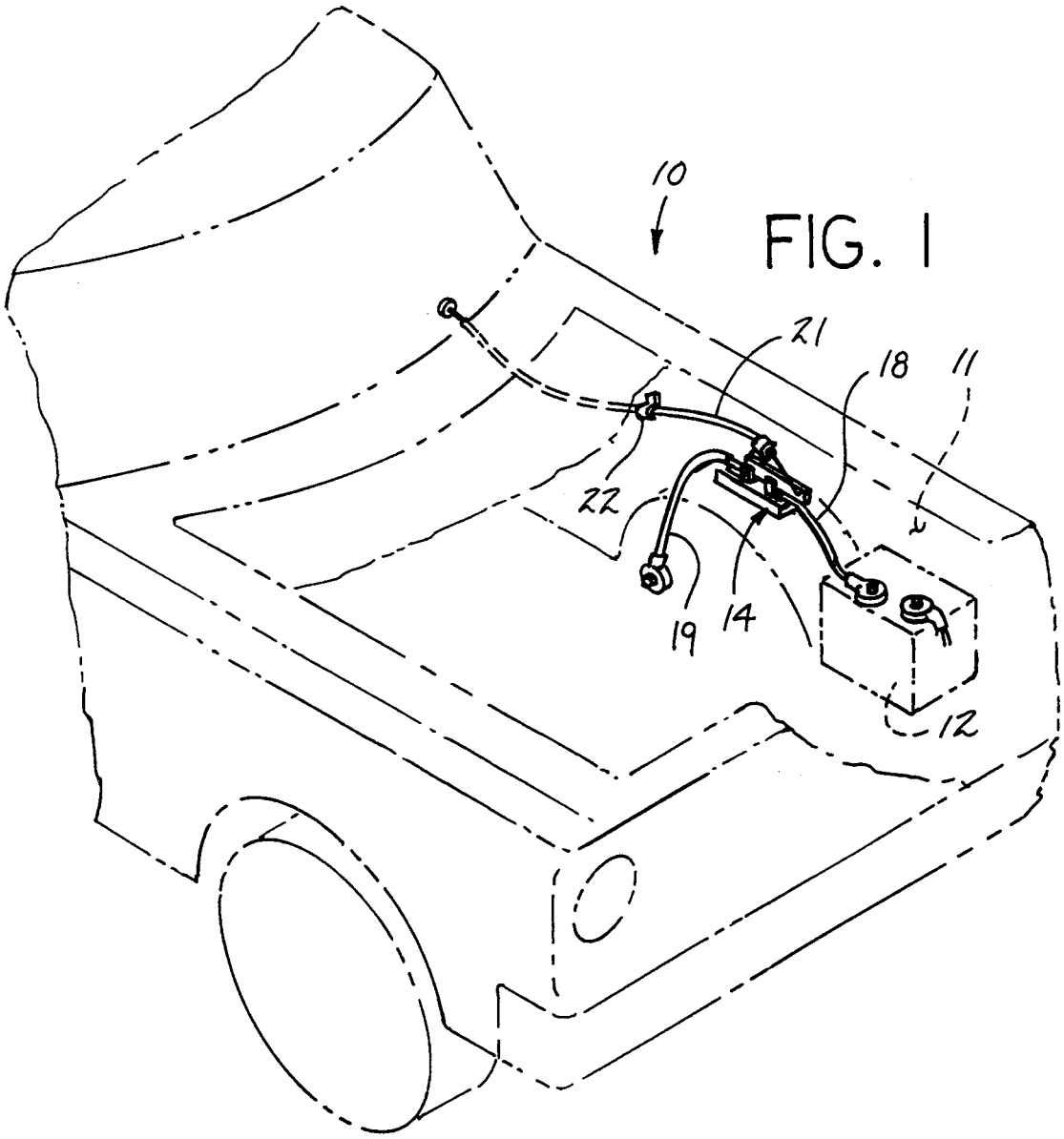
FIG. 1 is an isometric illustration of the invention positioned within an associated vehicle.
Figure 2:
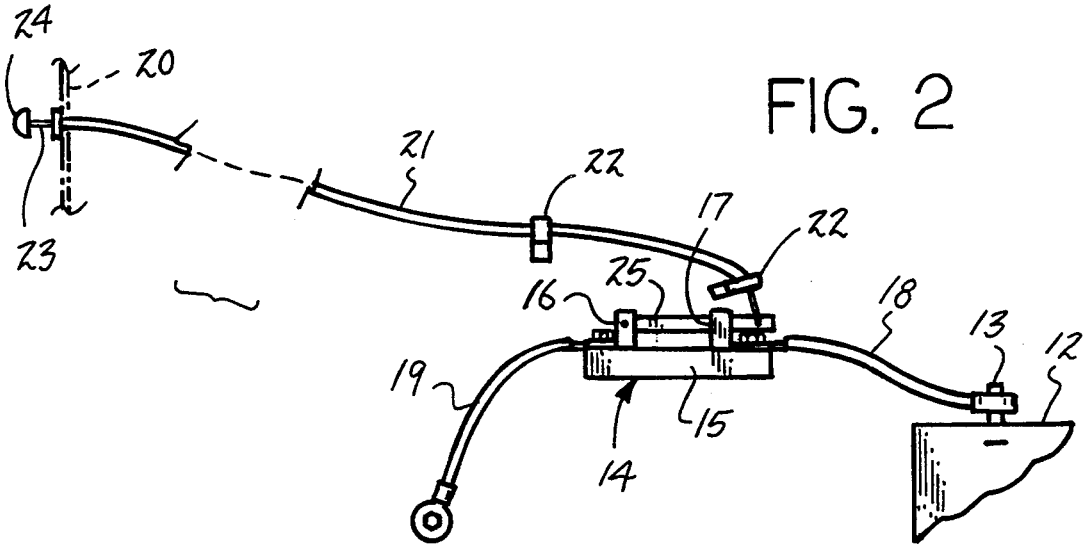
FIG. 2 is an orthographic side view of the invention.
Figure 3:
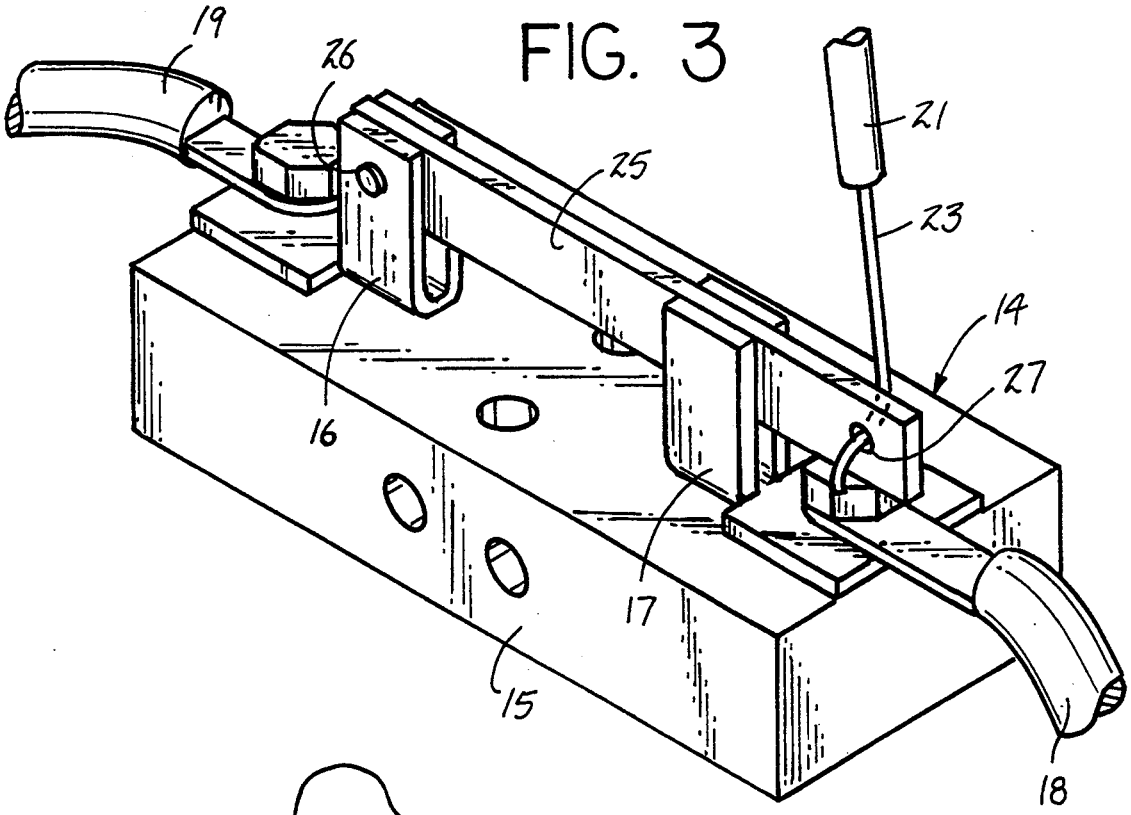
FIG. 3 is an enlarged isometric illustration of the switch structure.
Figure 4:
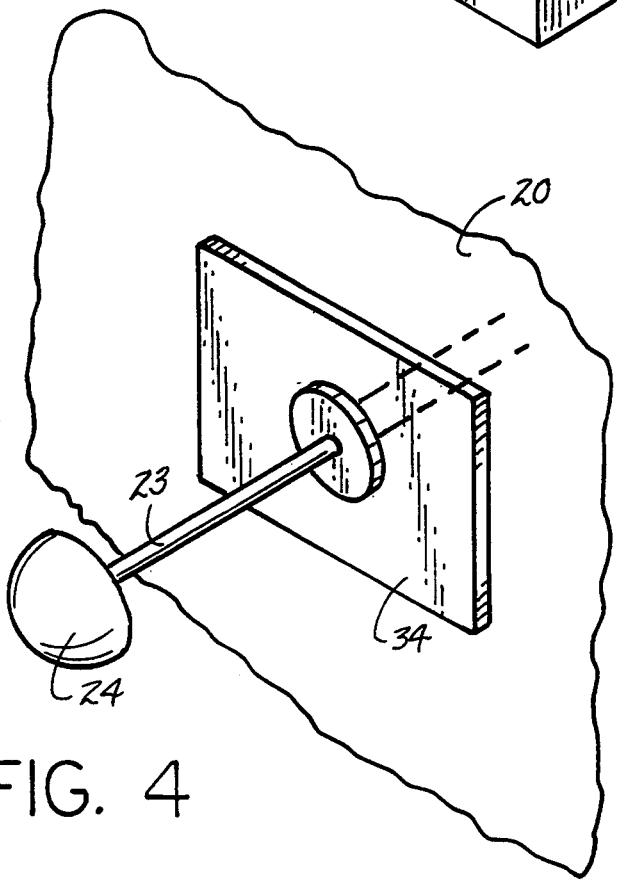
FIG. 4 is an enlarged isometric illustration of the cable mounted within the dashboard portion within the associated vehicle.

With reference now to the drawings, and in particular to FIGS. 1 to 8 thereof, a new and improved vehicular power cut off apparatus embodying the principles and concepts of the present invention and generally designated by the reference numeral 10 will be described.

More specifically, the vehicular power cut off apparatus 10 of the instant invention essentially comprises positioning within a vehicular engine compartment 11 in electrical communication with a vehicular battery 12 through the battery negative terminal 13. A knife switch member 14 is provided, having a support plate 15, including spaced first and second bifurcated contact posts 16 and 17 mounted to the top surface of the support plate 15, with the second contact post 17 having a first electrical cable 18 directed from the battery negative terminal 13 in electrical communication with that second bifurcated contact post 17. A second electrical cable 19 is directed from the first contact post 16 to a source of electrical ground within the engine compartment 11. A vehicular dashboard 20 includes a guide sheath 21 directed between the dashboard 20 and the switch member 14, wherein the guide sheath 21 includes a sheath first end secured to the dashboard 20, with a sheath second end secured to a guide clamp 22 in adjacency to the switch member 14. A flexible control cable 23 is slidably directed through the guide sheath 21, having a cable first end secured to a handle 24 projecting beyond the vehicular dashboard 20 from a cable mounting plate 34. The cable second end is secured to a switch knife blade 25, wherein the knife blade 25 has a blade first end axle 26 pivotally mounting the knife blade within the bifurcated first contact post 16, and the cable second end is secured to the blade second end bore 27 positioned in adjacency relative to the blade second end. In this manner, displacement of the control cable 23 effects selective opening and closing of the switch member 14 relative to the spacing and reception of the knife blade within the second contact post 17.

Figure 5:
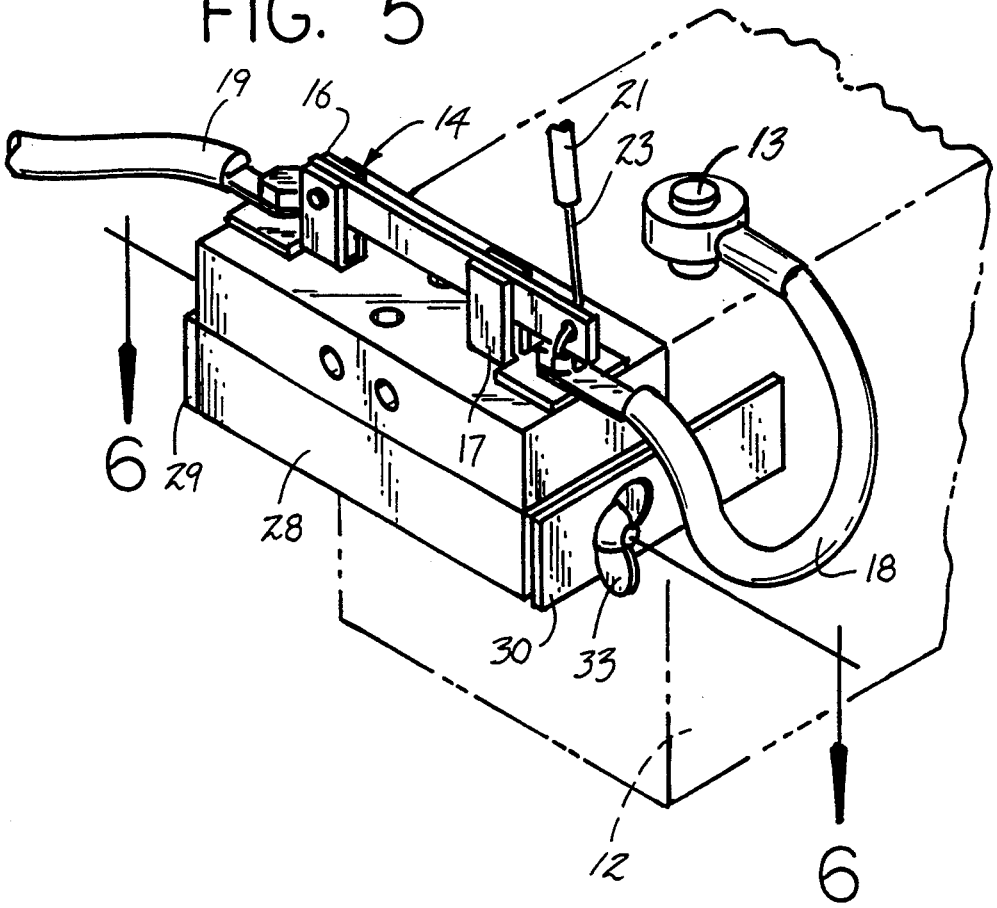
FIG. 5 is an isometric illustration of the switch employing a clamp structure for mounting to the associated battery.
Figure 6:
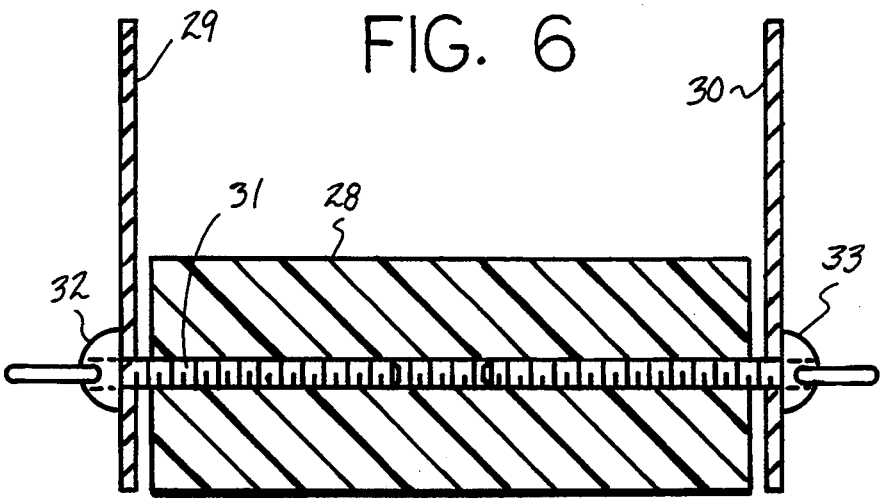
FIG. 6 is an orthographic view, taken along the lines 6—6 of FIG. 5 in the direction indicated by the arrows.

A resilient mounting block 28 is provided, as indicated in FIGS. 5 and 6, fixedly secured to a bottom wall of the support plate 15, wherein respective first and second clamp plates 29 and 30 arranged in a parallel relationship on opposed ends of the mounting block 28 include an externally threaded clamp rod 31 directed through the first and second clamp plates 29 and 30 in an orthogonal relationship, as well as through the mounting block 28, whereupon first and second fasteners 32 and 33 mounted in adjacency to the first end clamp plates 29 and 30 are threadedly directed to the clamp rod 31 to compress the mounting block 28 permitting securement of the switch member 14 to the associated battery 12 for ease of mounting of the switch member within a vehicular passenger compartment 11.

Figure 7:
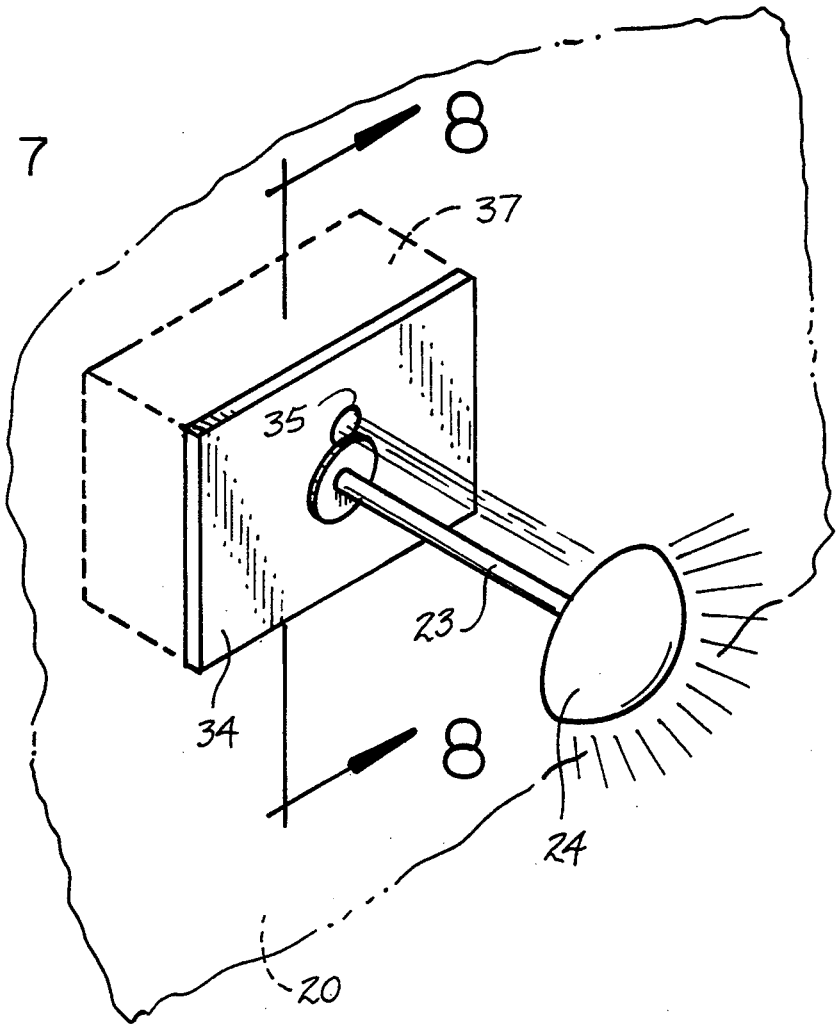
FIG. 7 is an isometric illustration of the pull handle structure in operative association with illumination means.
Figure 8:
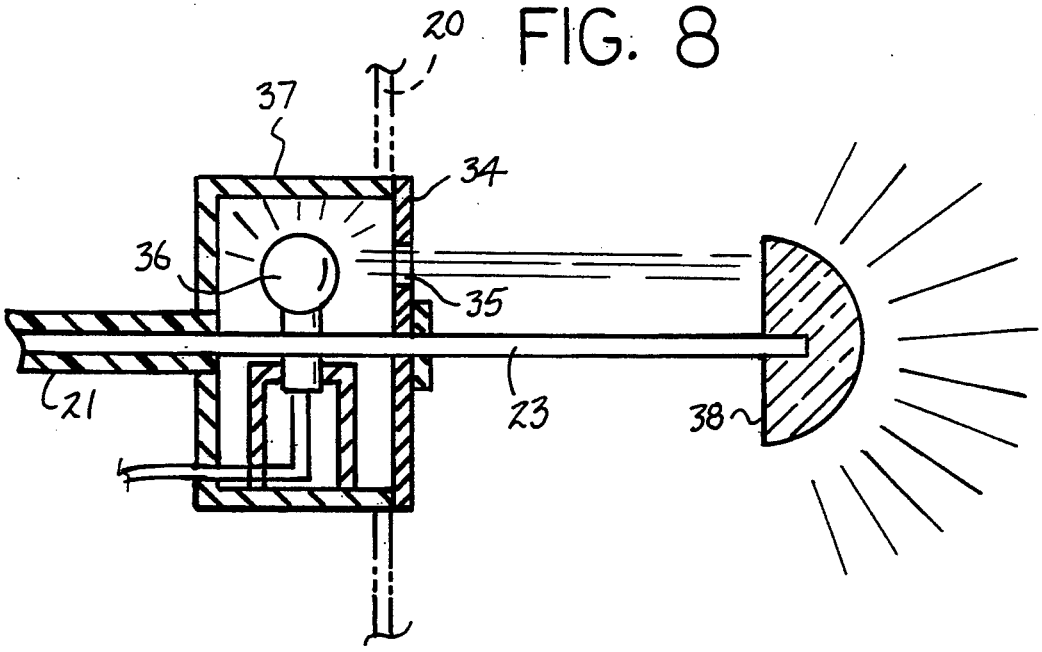
FIG. 8 is an orthographic view, taken along the lines 8—8 of FIG. 7 in the direction indicated by the arrows.

The FIGS. 7 and 8 indicate that the handle 24 formed of a translucent material is arranged for reciprocation relative to the cable mounting plate 34, and more specifically the handle planar base 38 is positioned in a first position in contiguous communication with a plate aperture 35 and in a second position displaced from the aperture 35, wherein within a housing 37 mounted to a rear wall of the mounting plate 34, an illumination bulb 36 positioned in adjacency to the aperture 35 directs illumination into the handle 24 permitting ease of viewing during periods of limited available light such as in evening hours, and where the illumination is maintained when the planar base 38 is arranged in adjacency to the aperture 35 and is eliminated when the handle is displaced due to the discontinuance of electrical energy to the illumination bulb 36, as the illumination bulb is typically arranged in operative communication with the battery 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vehicular power cut off apparatus in combination with a vehicular engine compartment having a battery therewithin, the battery including at least a negative terminal, the vehicular engine compartment further having an electrical ground, wherein the apparatus comprises, a knife switch member having a support plate, the support plate including a first bifurcated contact post spaced from and aligned with a second bifurcated contact post, a first electrical cable is mounted in electrical communication with the first contact post and to the battery negative terminal, and a second electrical cable is secured to and directed from the second bifurcated contact post to the electrical ground within the vehicular engine compartment, and a vehicular dashboard spaced from the vehicular engine compartment, and a guide sheath directed from the vehicular dashboard into the vehicular engine compartment, the guide extends through the vehicular dashboard in adjacency to the switch member, wherein a cable mounting plate is mounted to the dashboard, and the sheath having a sheath first end mounted to the cable mounting plate, at least one guide clamp mounted within the vehicular engine compartment in adjacency to the switch member, and the sheath having a sheath second end mounted to the guide clamp, and a flexible control cable slidably directed through the guide sheath, the control cable having a handle secured to the control cable in adjacency to the cable mounting plate, and the cable having a distal end secured to the switch member, with the switch member having a knife blade having a first end axle pivotally mounting the knife blade to the second bifurcated contact post, the knife blade having a knife blade second end, with the control cable distal end mounted to the knife blade second end for selective displacement of the knife blade relative to the first bifurcated contact post, and the support plate includes a support plate bottom wall and a support plate top wall, the support plate top wall has secured thereto the first bifurcated contact post and the second bifurcated contact post, wherein the support plate bottom wall includes a resilient mounting block, and the resilient mounting block is arranged in continuous and fixed communication to the support plate bottom wall, and an externally threaded clamp rod directed through the mounting block, with the clamp rod including a first clamp plate and a second clamp plate arranged in a spaced parallel relationship relative to one another on opposed sides of the mounting block, with the clamp rod directed through the first clamp plate and the second clamp plate, with a first fastener mounted to the clamp rod in communication with the first clamp plate, and a second fastener mounted to the clamp rod in adjacency and in communication with the second clamp plate, whereupon securement of the first fastener and the second fastener to the clamp rod effects securement of the clamp rod to the battery, wherein the battery is positioned between the first clamp plate and the second clamp plate.

2. An apparatus as set forth in claim 1 wherein the cable mounting plate includes an aperture directed therethrough, the cable mounting plate including a housing mounted to the cable mounting plate, with the housing including an illumination bulb, and the illumination bulb positioned in adjacency to the aperture, and the handle formed of a translucent material, with the handle having a handle planar base positioned in adjacency to the aperture when the handle is in the first position and the second contact post is in contiguous communication to the knife blade, and the handle displaced relative to the cable mounting plate effecting discontinuous electrical energy to the illumination bulb when the knife blade is displaced from the second contact post.

* * * * *